US009289785B2

(12) United States Patent
Buehler et al.

(10) Patent No.: US 9,289,785 B2
(45) Date of Patent: Mar. 22, 2016

(54) SHOWER HEAD

(71) Applicant: Hansgrohe SE, Schiltach (DE)

(72) Inventors: Juergen Buehler, Schiltach (DE); Fabian Melle, Durbach (DE)

(73) Assignee: Hansgrohe SE, Schiltach (DE)

( * ) Notice: Subject to any disclaimer, the term of this patent is extended or adjusted under 35 U.S.C. 154(b) by 240 days.

(21) Appl. No.: 13/952,754

(22) Filed: Jul. 29, 2013

(65) Prior Publication Data

US 2014/0034758 A1 Feb. 6, 2014

(30) Foreign Application Priority Data

Aug. 1, 2012 (DE) ..... 10 2012 213 518

(51) Int. Cl.

| | |
|---|---|
| ***A62C 31/00*** | (2006.01) |
| ***B05B 1/16*** | (2006.01) |
| ***B05B 15/02*** | (2006.01) |
| ***B05B 1/18*** | (2006.01) |
| ***B05B 1/30*** | (2006.01) |

(52) U.S. Cl.

CPC ..... *B05B 1/1681* (2013.01); *B05B 1/16* (2013.01); *B05B 1/1609* (2013.01); *B05B 1/1636* (2013.01); *B05B 1/18* (2013.01); *B05B 1/3006* (2013.01); *B05B 15/0208* (2013.01); *B05B 15/0291* (2013.01); *Y10S 239/12* (2013.01)

(58) Field of Classification Search

CPC ..... B05B 1/16; B05B 1/18; B05B 1/1681; B05B 1/1609; B05B 1/3006; B05B 1/1636; B05B 15/0291; B05B 15/0208; Y10S 239/12

USPC ..... 239/443, 444, 446, 106, 107, 525, 530, 239/556, 557, 559–562, 533.13, 533.14, 239/602, DIG. 12

See application file for complete search history.

(56) References Cited

U.S. PATENT DOCUMENTS

| | | | | |
|---|---|---|---|---|
| 5,405,089 | A * | 4/1995 | Heimann et al. | 239/533.14 |
| 7,100,845 | B1 * | 9/2006 | Hsieh | 239/447 |
| 7,740,186 | B2 * | 6/2010 | Macan et al. | 239/446 |
| 7,913,934 | B2 | 3/2011 | Schorn | |
| 7,918,408 | B2 * | 4/2011 | Tshieh | 239/444 |
| 8,066,203 | B2 * | 11/2011 | Zhou | 239/443 |

(Continued)

FOREIGN PATENT DOCUMENTS

| | | | |
|---|---|---|---|
| DE | 2911937 | A1 | 10/1980 |
| DE | 102007002894 | B3 | 9/2008 |
| DE | 102008028239 | B4 | 8/2010 |
| EP | 1944089 | A2 | 7/2008 |

OTHER PUBLICATIONS

Office Action dated Feb. 27, 2013 in DE 10 2012 213 518.9.

(Continued)

*Primary Examiner* — Steven J Ganey

(74) *Attorney, Agent, or Firm* — Duane Morris LLP

(57) ABSTRACT

A shower head contains a shower head housing with a jet disc having jet outlet openings. A water inlet leads into the shower head housing and adjoins a changeover valve that switches between three water supplies. Each water supply leads to a different group of jet outlet openings in the jet disc. An opening closed by a seal of deformable material is provided between each two groups of jet outlet openings. The seal is designed such that the opening opens when pressure is applied from one side and the opening closes when pressure is applied from the other side.

14 Claims, 4 Drawing Sheets

(56) References Cited

U.S. PATENT DOCUMENTS

Figure 1:
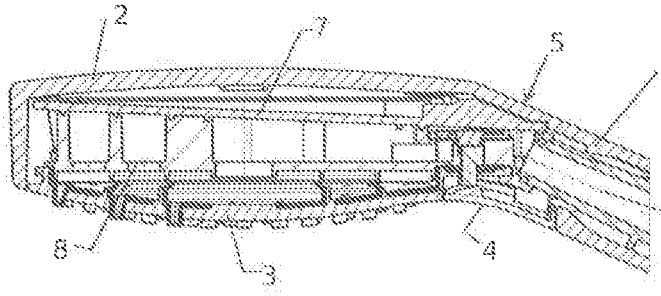

| | | | | |
|---|---|---|---|---|
| 9,068,329 | B2 * | 6/2015 | Gransow | B05B 1/16 |
| 2008/0156902 | A1 | 7/2008 | Luettgen et al. | |
| 2012/0325928 | A1 | 12/2012 | Gransow et al. | |

OTHER PUBLICATIONS

Notice of opposition in DE 102012213518.9, dated Jul. 2, 2014.
Opposition of Kludi GmbH & Co. KG, dated Feb. 21, 2014.
Search Report dated Nov. 13, 2013 in EP13176878.0.

* cited by examiner

Fig. 5
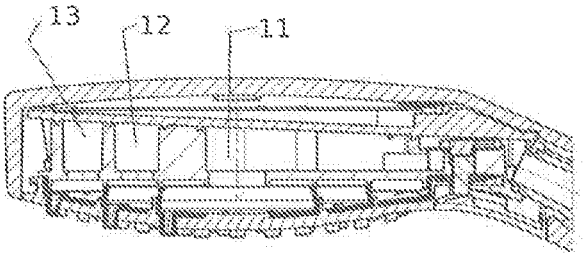
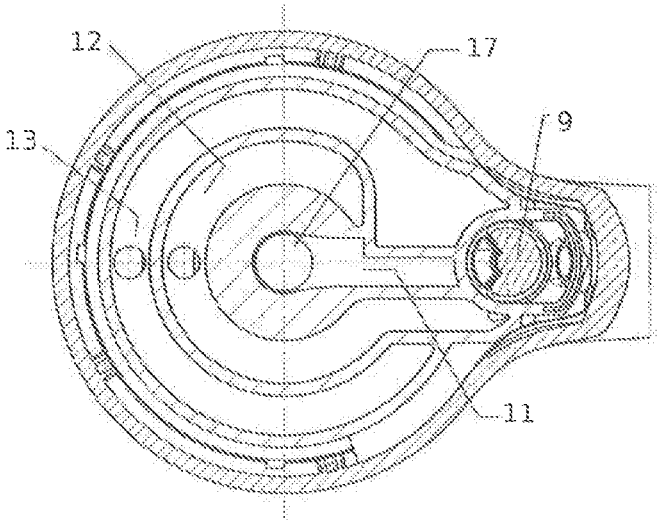
Fig. 6

SHOWER HEAD

The invention relates to a shower head for a sanitary shower where several water supplies leading to different jet outlet openings are arranged in a shower head housing.

The object of the invention is to provide a shower head which is of very simple design, can be easily assembled and leads to a precisely defined seal between the jet outlet openings.

To solve this problem, the invention proposes a shower head comprising a shower head housing, which is sealed by a jet disc having jet outlet openings, a water inlet into the shower head housing, at least two water supplies separated from one another inside the shower head housing, which each lead to a group of jet outlet openings in the jet disc, and a seal which is arranged between each two groups of jet outlet openings and which closes at least temporarily an opening between the groups of jet outlet openings and so seals the groups of jet outlet openings from one another. Further embodiments of the invention are the subject-matter of subclaims.

Due to the separate water supplies inside the shower head housing and the sealing between the groups of jet outlet openings, it is ensured that the water entering a water supply indeed only exits through the associated group(s) of jet outlet openings.

In the simplest case, sealing can be designed such that it is produced when the shower head housing is assembled, for example when the jet disc is connected to the shower head housing.

In a development of the invention, it can be provided that the sealing between the groups of jet outlet openings forms a kind of valve device which, depending on the side from which a pressure applied by the water inside the shower head housing acts on the seal, closes or opens the opening. In other words, the seal is only effective in one direction. It can be pretensioned here in such a way that when the pressure is applied in the reverse direction, it only opens when a certain pressure is exceeded.

In particular, it can be provided in a development of the invention that the seal is formed by an element which is deformable by water pressure and which contacts a preferably fixed rim of the opening between the two groups of jet outlet openings in order to achieve sealing. The movement of the valve device occurs in this case only due to a deformation of an element in itself, meaning that no movable parts are required.

It can be provided in a development in accordance with the invention that the deformable element is formed by a lip integrally moulded on a lining made of an elastomer material and contacting the inside of the jet disc. This lining of elastomer material can then simultaneously ensure rim sealing of the jet disc, so that the number of individual parts required for the shower head housing does not increase.

The lip can be of varying stiffness along its longitudinal extent, such that it is continuously sealing in the area of differing radius, for example, while retaining its movable function in other areas. The differing stiffness can for example be achieved by a differing thickness of the lip.

It is also possible for the opening to have a different width.

The elastomer lining can be made together with the jet disc as a two-component part. It is however also possible for it to be made and inserted as a separate mat.

It can be provided in a development in accordance with the invention that the deformable lip is integrally moulded on that elastomer lining which also has integrally moulded nipples for the formation of jet outlet ducts.

It can be expediently provided that the opening between the two groups of jet outlet openings has the form of a slot whose longitudinal direction can be approximately parallel to the jet disc.

The at least two water supplies in the shower head housing can for example originate from an inlet already forming several separate inlet ducts into the shower head housing. Preferably however, it can be provided in a development of the invention that inside the shower head housing or immediately in front of it a changeover valve is arranged which is inserted between the water inlet into the housing and the water supplies and supplies the water supply with water depending on its setting.

The groups of jet outlet openings are arranged, according to a further proposal of the invention, preferably in an annular form, so that a group of jet outlet openings surrounds another group in annular form. The shape of the rings can vary here from circular to rectangular shape and assume any required shape.

Depending on the circumstances of the specific case or on the requirements of the designer, the direction in which the seal is released can be varied. In accordance with the invention, the solution preferred is that in which the permeability of the valve device is from the outside to the inside. This means that when the respective inner group of jet outlet openings is supplied with water, the outer group is not supplied, whereas when the outer group of jet outlet openings is supplied, the water also exits from the inner group.

If three chambers are provided, it can be provided in a development in accordance with the invention that when the middle of the three chambers is supplied with water, the inner and outer chambers are also opened, but conversely this is not the case.

It can be provided in a development in accordance with the invention that the shower head has an intermediate disc adjacent to the jet disc, i.e. directly behind the jet disc. The seal can then be provided between this intermediate disc and the jet disc. In particular, it can be provided that the rim of the valve opening is formed on the intermediate disc.

In another development of the invention, it can be provided that the valve opening extends in annular form around the respective group of jet outlet openings.

In accordance with the invention, it can be provided that the water supplies are arranged in front of the intermediate disc and that the connection between the water supplies and the associated groups of jet outlet openings is achieved in each case by at least one opening in the intermediate disc.

Figure 2:
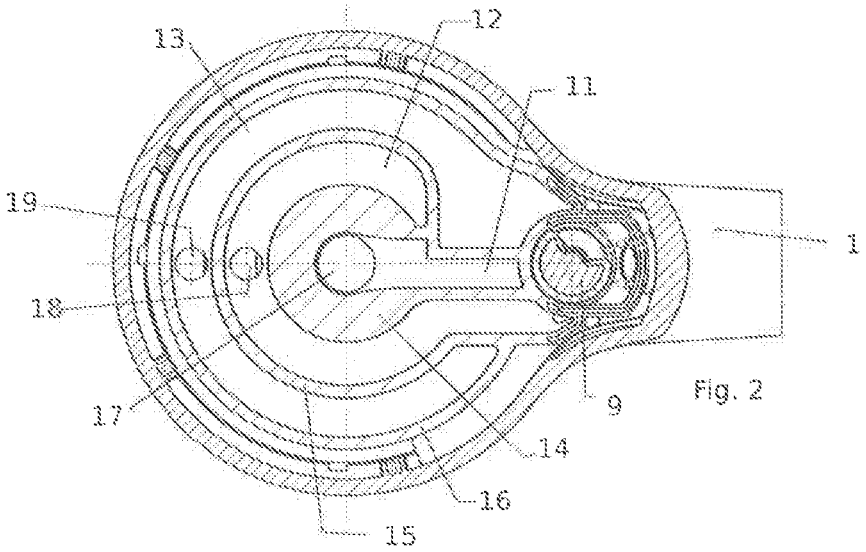
Figure 3:
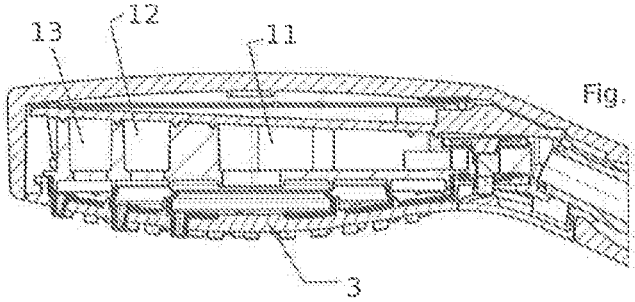
Figure 4:
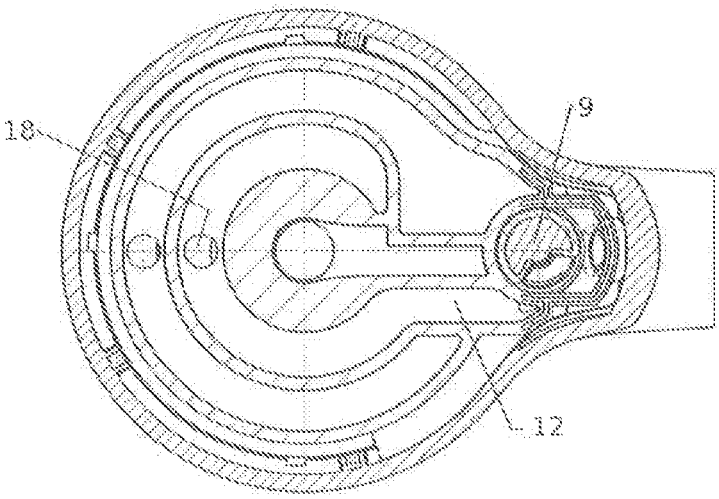
Figure 9:
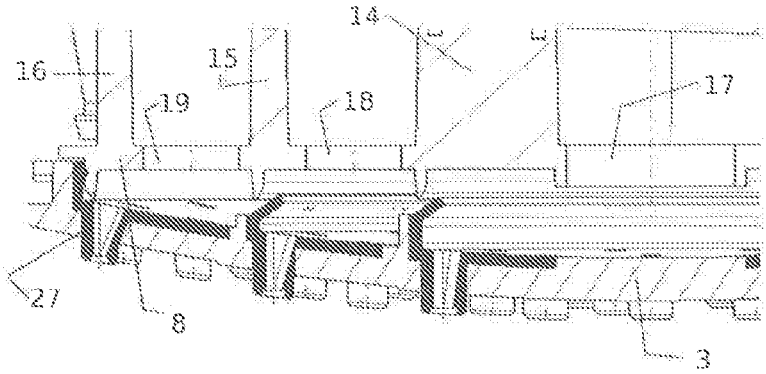
Figure 8:
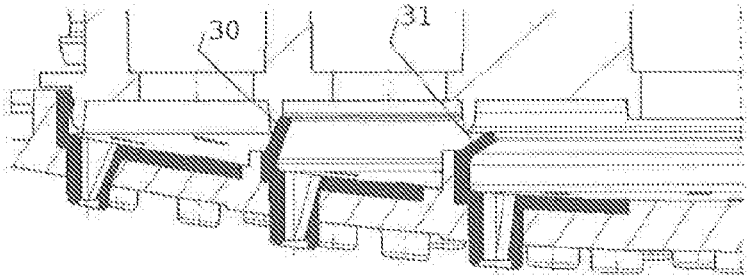
Figure 7:
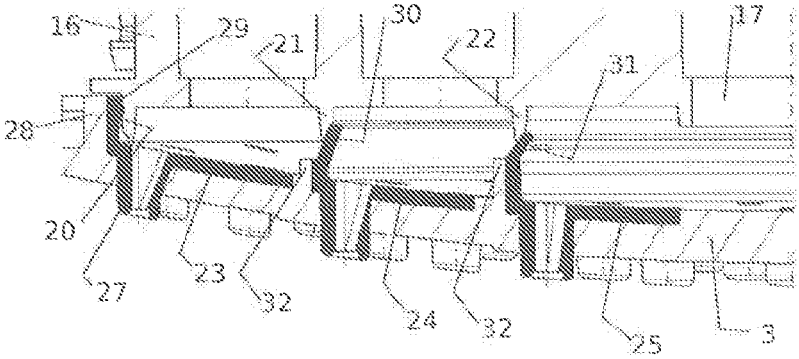

Further features, details and advantages of the invention are shown in the claims and in the abstract, the wordings of both of which are made into the substance of the description by reference, in the following description of preferred embodiments of the invention, and by the drawing. The drawings show in:

FIG. 1 a cross-section through a shower head according to the invention;

FIG. 2 a cross-section vertical to the section in FIG. 1 through the shower head in a first position of a changeover valve;

FIG. 3 a view corresponding to FIG. 1 in another position of a changeover valve;

FIG. 4 a view corresponding to FIG. 2 with the position of the changeover valve corresponding to FIG. 3;

FIG. 5 another section through the shower head housing corresponding to FIG. 1 in FIG. 3;

FIG. 6 a section through the shower head housing corresponding to FIGS. 2 and 4 in a further position of the changeover valve;

FIG. 7 an enlarged partial section in a first position of the seal;

FIG. 8 a section corresponding to FIG. 7 in a second position of the seal;

FIG. 9 a section corresponding to FIGS. 7 and 8 in a third position of the seal;

FIG. 1 shows a section through the shower head of a hand shower, where the handle 1 is shown only in part. The shower head contains a shower head housing 2 that is closed on one side by a jet disc 3. The jet disc 3 is immovably connected to the shower head housing 2. A button 4 for operating a changeover valve 5 is arranged in the area between the shower head housing 2 and the handle 1 on the same side of the shower head housing 2 on which the jet disc 3 is arranged. This changeover valve 5 is inserted between the water inlet in the shower head 2 and the water supplies present in the shower head. The water enters the shower head 2 through a duct 6 inside the handle 1 of the hand shower. In the embodiment shown, the handle 1 and the shower head housing 2 are a one-piece component.

Downstream of the changeover valve 5, two substantially flat discs 7, 8 are arranged in the shower head housing 2 and are approximately parallel to one another. One disc 7 is designed as the rear wall of the water supplies, the other intermediate disc 8 is placed directly behind the jet disc 3. The rear wall 7 of the water supplies is placed in front of the rear wall of the shower head housing 2.

The already mentioned water supplies are explained in more detail with reference to FIG. 2. From the changeover valve 5, the section in FIG. 2 shows the rotatable valve closing element 9 which supplies water to a defined water supply in the position of FIG. 2.

The shower head housing contains a total of three water supplies arranged downstream of the changeover valve 5. A first water supply 11 leads from the changeover valve 5 in a straight line as a duct into the centre of the approximately circular-cylindrical shower head.

Separated by a partition, a second water supply 12 designed as an approximately annular duct and adjoining at its one end the changeover valve 5 extends around the end of the first water supply. Separated by a further partition, the second water supply 12 is surrounded by a third water supply 13 likewise designed as an annular duct. This third water supply 13 is connected at one of its ends to the changeover valve 5.

All three water supplies 11, 12, 13 are separated from one another or from the outer rim of the shower head housing 2 by intermediate walls extending between the rear wall 7 and the intermediate disc 8. For example, the intermediate walls are integrally moulded on the intermediate disc 8 and are connected to the rear wall 7.

The intermediate wall 14 between the inner water supply 11 and the middle water supply 12 is designed relatively thick, while the other intermediate walls 15, 16 are designed thinner.

In the intermediate disc 8, an opening 17, 18, 19 respectively is provided in the area of each water supply 11, 12, 13, through which opening the water passes from the water supply into the space between the intermediate disc 8 and the jet disc 3.

In the position of FIGS. 1 and 2, the changeover valve 5 is set such that the water leaving the changeover valve 5 passes into the third water supply 13. The connection is made outside the plane of the drawing. The water present in the third water supply 13 can therefore pass through the opening 19 in the intermediate disc 8 into the area behind the jet disc 3.

The jet disc has jet openings, shown in more detail later, which are designed as nipples of an elastomer material, all nipples being integrally moulded on a lining of the same material contacting the inside of the jet disc 3. Sealing elements are also integrally moulded on this lining which in the area between the intermediate disc 8 and the jet disc 3 seal off from one another spaces associated with the three water supplies 11, 12, 13. The shower head housing can be assembled very easily from a few parts, where the sealing elements on the rear of the jet disc 3 then assume the sealing function. The lining also has seals which seal off the outer rim of the jet disc.

In the representation in FIGS. 3 and 4, the valve dosing element 9 of the changeover valve 5 is moved into a rotary position in which the outlet of the changeover valve 5 is connected to the middle water supply 12. As soon as the water is flowing in through the duct 6, it therefore enters the middle water supply 12 and from the latter passes through the opening 18 into the space between the intermediate disc 8 and the jet disc 3.

In FIGS. 5 and 6, the representation is selected such that the valve closing element 9 of the changeover valve 5 is oriented such that the first water supply 11 can be supplied with water. The water therefore flows out of the first water supply 11 through the middle opening 17 into the area between the intermediate disc 8 and the jet disc 3.

The three following FIGS. 7 to 9 explain in more detail and in an enlarged scale the mode of operation of the invention on the basis of an embodiment. The three figures here show details from the sections in FIGS. 1, 3 and 5 in an enlarged scale.

On the front side of the intermediate disc 8 facing the jet disc 3, several all-round ribs are integrally moulded, i.e. a rib 20 in the area of the radial outer face, a further rib 21 between the openings 19 and 18 of the third and second water supplies, and a third rib 22 between the second and first water supplies.

Linings 23, 24 and 25 are fastened on the inside of the jet disc 3, consisting of an elastomer material and extending as rings around the entire jet disc. The three linings could also be part of a common lining. The largest part of them is located in a recess in the rear side 26 of the jet disc 3. A plurality of nipples 27 is integrally moulded on the front of the linings, projecting through holes in the jet disc 3 as far as the front or outside of the jet disc 3 and protruding slightly on the front side. There is a plurality of such nipples 27 extending over the entire circumference of the jet disc. The nipples 27 form the jet outlet openings. All nipples 27 integrally moulded on a lining 23 and/or 24 and/or 25 each form a group of jet outlet openings.

A rib 28 is also provided in the radial outer area on the rear of the jet disc 3, being parallel to the outer rib 20 of the intermediate disc 8 and at a short distance from the latter.

A lip 29, 30, 31 is integrally moulded on the inward facing rear of the linings at their respective radial outer rims. Each lip runs approximately at right angles to the rear of the jet disc 3. The lip 29 is located between the rib 28 of the jet disc 3 and the rib 20 of the intermediate disc 8 and thereby seals this intermediate space.

The lip 30 counted second from the radial outside contacts the radial inside of the second rib 21 of the intermediate disc 8 with a defined pretension.

The next lip 31 inwards in the radial direction contacts in the same way the third rib 22 of the intermediate disc 8.

The second and third lips from the outside can each be supported by a web 32. Supporting webs can also come from the opposite intermediate disc.

In the position shown in FIG. 7, the lips 30 and 31 seal the groups of outlet openings from one another. Since each group of outlet openings is connected via the appropriate openings 17, 18, 19 to a water supply 11, 12, 13 respectively, the water supplies each supply water to one group of outlet openings.

The deformable lips 30 and 31 each contact a rib 21 or 22 respectively. The intermediate space between the webs 32 and the respective rib 21 or 22 forms a slot-like opening extending around the centre point of the jet disc. This opening is sealed by the respective lip 30, 31 in the pressureless state as shown in FIG. 7.

In the embodiment shown, the mode of operation of the shower is as follows. It is assumed that the changeover valve 5 is switched to the position shown in FIGS. 5 and 6, in which the water supply 11 is connected to the inlet into the shower head housing: if the water supply to the shower is then switched on, the water flows through the water supply 11 and through the opening 17 in the intermediate disc 8 into the space between the intermediate disc 8 and the jet disc 3. Since the opening is closed by the lip 31, the water flows only out of those jet outlet openings which are arranged inside the area limited by the rib and integrally moulded on the lining 25. The water therefore flows out of the jet disc 3 only in a middle area. The pressure of the water in this area keeps closed the opening sealed by the lip 31.

If the changeover valve is now reset such that the valve closing element 9 takes up the position shown in FIGS. 3 and 4, the water flows into the second water supply 12 and from this through the opening 18 in the intermediate disc 8 into the area between the ribs 21 and 22 and the lips 30 and 31. A second group of jet outlet openings is associated with this space, i.e. the nipples 27 integrally moulded on the lining 24. The water pressure however deforms the Hp 31 provided on the radial inside face of this area such that the slot-like opening between the rib 22 and the web 32 opens. The water therefore flows not only out of the second group of jet outlet openings, but also out of the middle area. The opening closed by the Hp 30 between the web 32 and the rib 21 remains however sealed. In other words, the water now flows out of the jet disc from a larger area. This state is shown in FIG. 8.

If the changeover valve is now operated so that the valve closing element 9 assumes the position shown in FIG. 2, then the water flows into the third water supply 13 and through the openings 19 provided there into the intermediate space between the ribs 20 and 21 on the front of the intermediate disc 8. The water pressure now opens the opening between the web 32 and the rib 21, and also the opening between the web 32 and the rib 22. The water now flows out of all groups of jet outlet openings.

It is of course possible that when the water pressure is low the openings only open slightly.

In another embodiment, in which for example the lips contact the other side of the ribs respectively, another type of association between the water supplies and the jet outlet openings supplied with water can be achieved.

The invention claimed is:

1. A shower head, comprising a shower head housing, which is sealed by a jet disc having at least two groups of jet outlet openings, a water inlet into the shower head housing, at least two water supplies separated from one another inside the shower head housing, each of the water supplies leading to one of said at least two groups of jet outlet openings in the jet disc, and a seal which comprises an element deformable by water pressure and which is arranged between the at least two groups of jet outlet openings and which selectively closes an opening between the at least two groups of jet outlet openings so as to seal them from one another, or opens said opening so as to effect fluid communication between the at least two groups of jet outlet openings.

2. The shower head according to claim 1, wherein the seal forms a valve device which closes the seal between the at least two groups of jet outlet openings when pressure is applied by the water in the shower head housing from one side of the element deformable by water pressure and releases the seal when pressure is applied by water in the shower head housing from an other side of said element.

3. The shower head according to claim 1, wherein the element deformable by water pressure closes against a non-deformable rim of the opening.

4. The shower head according to claim 3, wherein the deformable element is formed by a lip integrally moulded on an elastomer lining on the inside of the jet disc.

5. The shower head according to claim 4, wherein nipples for forming jet outlet ducts are integrally moulded on the elastomer lining.

6. The shower head according to claim 3, further comprising an intermediate disc adjacent to the jet disc, and wherein the rim of the opening is provided on the intermediate disc.

7. The shower head according to claim 1, wherein the opening between the two groups of jet outlet openings has a slot shape.

8. The shower head according to claim 1, further comprising a changeover valve in the shower head housing between the water inlet and each of the water supplies.

9. The shower head according to claim 1, wherein at least one of the at least two groups of jet outlet openings is arranged in the jet disc in annular form.

10. The shower head according to claim 9, wherein the fluid communication at the seal, acting as a valve device between the at least two groups of jet outlet openings, is provided from radially outwards to inwards.

11. The shower head according to claim 9, wherein the fluid communication at the seal, acting as a valve device between the at least two groups of jet outlet openings is provided from radially inwards to outwards.

12. The shower head according to claim 1, further comprising an intermediate disc adjacent to the jet disc.

13. The shower head according to claim 12, wherein each of the water supplies is arranged on an upstream side of the intermediate disc, each of the water supplies being connected to an associated space between the intermediate disc and the jet disc by at least one opening, respectively, leading from the water supply through the intermediate disc to a corresponding space between the intermediate disc and the jet disc.

14. The shower head according to claim 1, wherein the opening extends in annular form around a respective said at least two groups of jet outlet openings.

* * * * *